US007866903B2

(12) United States Patent
Hatada et al.

(10) Patent No.: US 7,866,903 B2
(45) Date of Patent: Jan. 11, 2011

(54) PRINTER AND EMISSION INTENSITY ADJUSTING METHOD

(75) Inventors: Kenji Hatada, Shiojiri (JP); Toru Hayashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 625 days.

(21) Appl. No.: 11/900,555

(22) Filed: Sep. 12, 2007

(65) Prior Publication Data

US 2008/0063459 A1 Mar. 13, 2008

(30) Foreign Application Priority Data

Sep. 12, 2006 (JP) ..... 2006-246392

(51) Int. Cl.
*B41J 29/38* (2006.01)
*B65H 7/14* (2006.01)

(52) U.S. Cl. ..... 400/76; 250/205; 250/214 C; 250/214 AG

(58) Field of Classification Search ..... None
See application file for complete search history.

(56) References Cited

U.S. PATENT DOCUMENTS 4,284,884 A * 8/1981 Dyment et al. ..... 250/205
6,348,697 B1 * 2/2002 Kitajima ..... 250/559.4
6,720,544 B2 * 4/2004 Barna et al. ..... 250/205
2003/0021608 A1 * 1/2003 Morita et al. ..... 399/23
2003/0031476 A1 * 2/2003 Takeuchi et al. ..... 399/16

FOREIGN PATENT DOCUMENTS

JP 03048466 A * 3/1991
JP 6-271147 9/1994
JP 06271147 A * 9/1994
JP 2000-109243 4/2000
JP 2000-289885 10/2000
JP 2003-307976 10/2003
JP 2005-081750 3/2005
JP 2005-313603 11/2005
JP 2005308593 A * 11/2005

* cited by examiner

*Primary Examiner*—Daniel J Colilla
(74) *Attorney, Agent, or Firm*—Nutter McClennen & Fish LLP; John J. Penny, V

(57) ABSTRACT

A printer for performing a printing operation on a printing medium, includes an optical sensor, operable to detect the printing medium; an emission intensity adjuster, operable to adjust emission intensity of a light-emitting element included in the optical sensor; and an output monitor, operable to monitor an output voltage of the optical sensor so as to control the emission intensity adjuster to adjust the emission intensity.

1 Claim, 7 Drawing Sheets

PRINTER AND EMISSION INTENSITY ADJUSTING METHOD

BACKGROUND

1. Technical Field

The present invention relates to a printer and a method of adjusting emission intensity of an optical sensor that is mounted on the printer.

2. Related Art

There is, as a printer for performing a printing operation on a printing medium, an ink jet printer including a print head for ejecting an ink to a printing medium and a carriage mounted with the print head. An optical sensor having a light-emitting element and a light-receiving element is widely used in such a type of printers. For example, the optical sensor is attached to a bottom surface of a carriage and is used to detect an end of a printing medium housed in the printer.

An optical sensor is exemplified which outputs a low-level signal at the time of detecting a printing medium and outputs a high-level signal at the time of not detecting the printing medium. When the optical sensor detects an end of the printing medium (an end close to a start point in the traveling direction of the carriage), it is judged whether a low level lasts by a predetermined size DW after an output of the sensor is changed from a high level to the low level. The size DW is set to be sufficiently larger than the width of a rib. When the low level lasts by DW, it is judged that the printing medium is detected but not the rib. As a result, the printer recognizes a coordinate of the carriage as an end of the printing medium when the high level is changed to the low level (for example, see JP-A-2005-081750).

As a printer mounted with an optical sensor, there is a printer which includes a printing unit for performing a printing operation on a printing medium, a supporting unit for supporting the printing medium to which the printing operation is performed by the printing unit, and an optical sensor that is disposed to be opposed to the supporting unit and to be movable relative to the supporting unit, that has a light-emitting portion and a light-receiving portion, and that generates a signal corresponding to the intensity of light received by the light-receiving portion (for example, see JP-A-2005-313603).

Such a printer detects a printing medium by comparing a predetermined threshold value with a value obtained by sampling a signal generated from the optical sensor with a predetermined period when the optical sensor moves relative to the supporting unit at the time of performing a printing operation. At the time of checking a state of the supporting unit, the printer samples the signal generated from the optical sensor with a period different from the predetermined period when the optical sensor moves relative to the supporting unit and changes a predetermined threshold value on the basis of the value obtained by the sampling.

When the existence of a printing medium is detected by the use of an optical sensor, it is preferable that a difference in output voltage between the existence and the non-existence of a printing medium is large. Accordingly, a value of current flowing in a light-emitting element of the optical sensor need be set equal to or greater than a predetermined value. In consideration of deterioration in output due to a variation of the optical sensor with the lapse of time, uneven outputs of optical sensors, or printing operations on various printing mediums, it is necessary to keep the output voltage of the optical sensor constant even when such conditions vary.

When a circuit mounted with an optical sensor is designed in consideration of such a problem, a phenomenon that a value of current flowing in the optical sensor is reduced even with an increase in voltage supplied to the optical sensor may occur due to characteristics of transistors in the circuit. When the output voltage of the optical sensor is small, the voltage supplied to the optical sensor is usually set to the maximum, but the value of current flowing in the optical sensor may not increase. Accordingly, it is required to optimally detect a printing medium even when such a phenomenon occurs.

SUMMARY

An advantage of some aspects of the invention is to provide a printer and an emission intensity adjusting method, which allow a printing medium to be detected in the optimum state even when conditions vary.

According to the present invention, there is provided a printer for performing a printing operation on a printing medium, the printer comprising:

an optical sensor, operable to detect the printing medium;

an emission intensity adjuster, operable to adjust emission intensity of a light-emitting element included in the optical sensor; and an output monitor, operable to monitor an output voltage of the optical sensor so as to control the emission intensity adjuster to adjust the emission intensity.

The present disclosure relates to the subject matter contained in Japanese patent application No. 2006-246392 filed on Sep. 12, 2006, which is expressly incorporated herein by reference in its entirety.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printer and an emission intensity adjusting method according to embodiments of the invention will be described with reference to the drawings.

(1) Schematic Configuration of Printer

Figure 1:
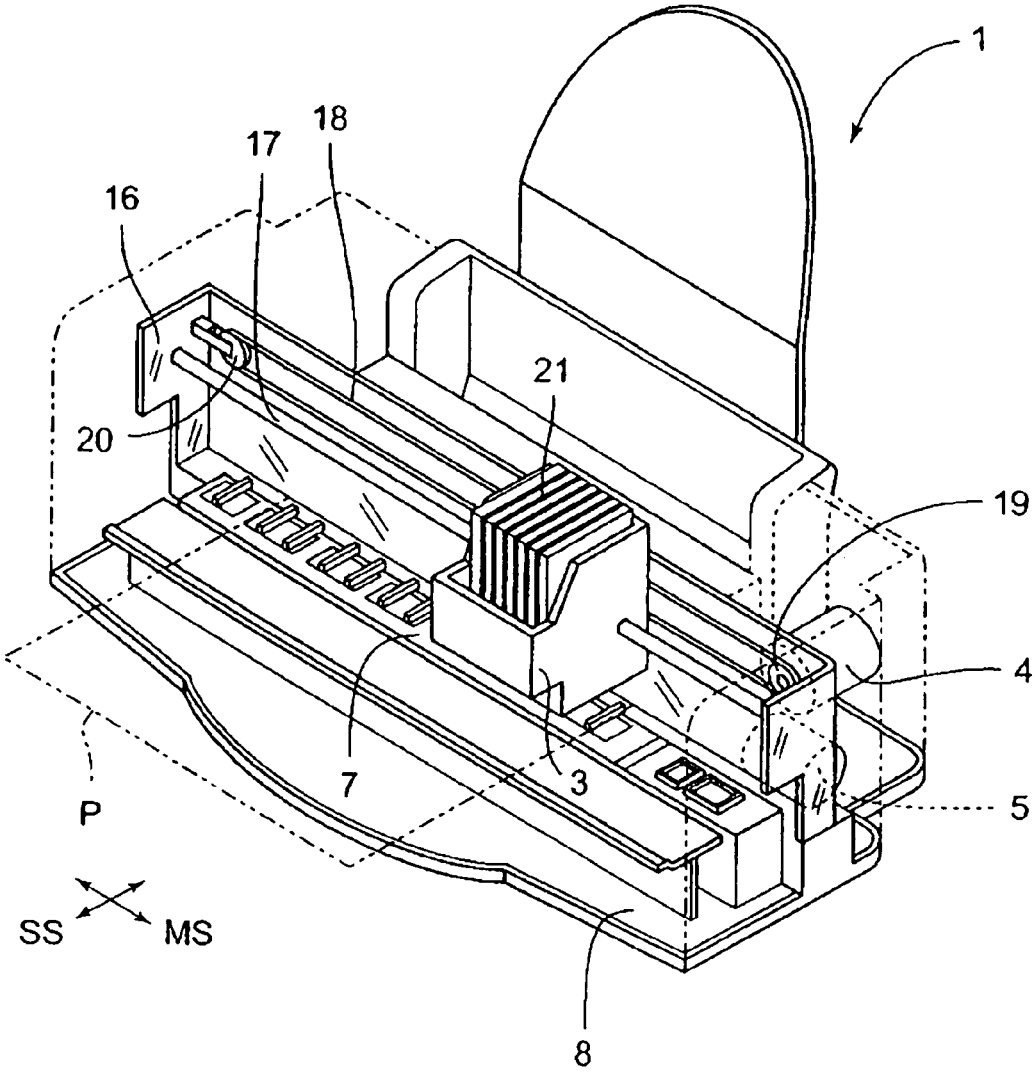
FIG. 1 is a perspective view schematically illustrating a configuration of a printer according to an embodiment of the invention.
Figure 2:
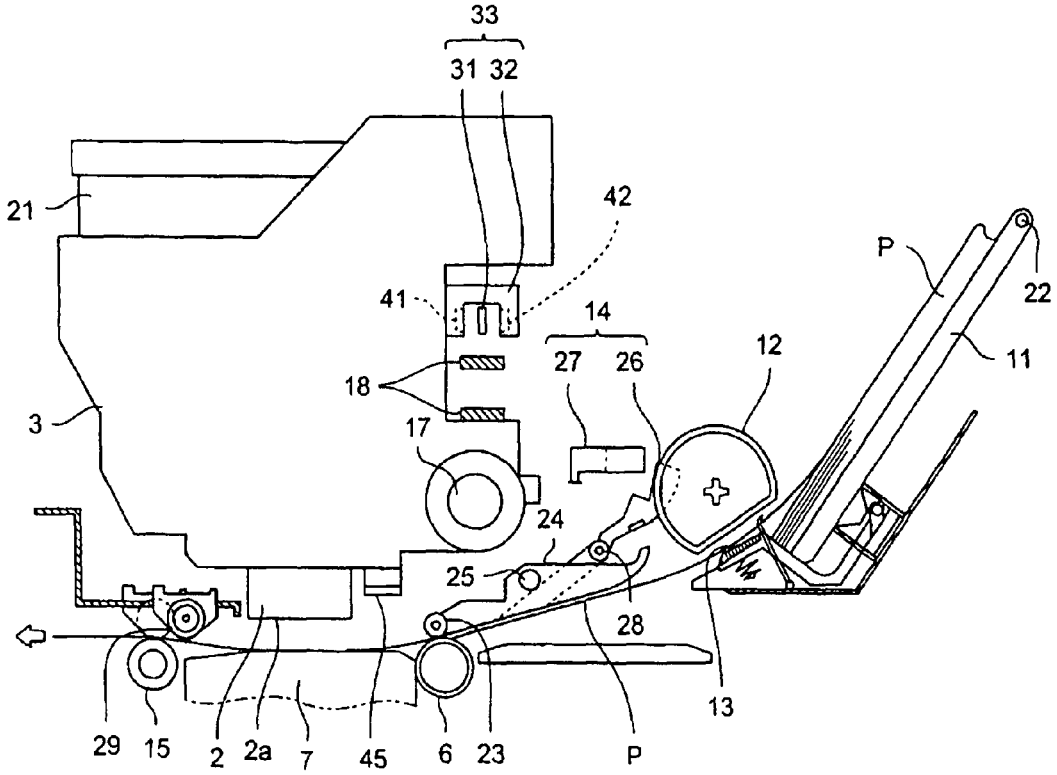
FIG. 2 is a side view schematically illustrating a configuration of a part associated with a paper feeding operation of the printer shown in FIG. 1.
Figure 3:
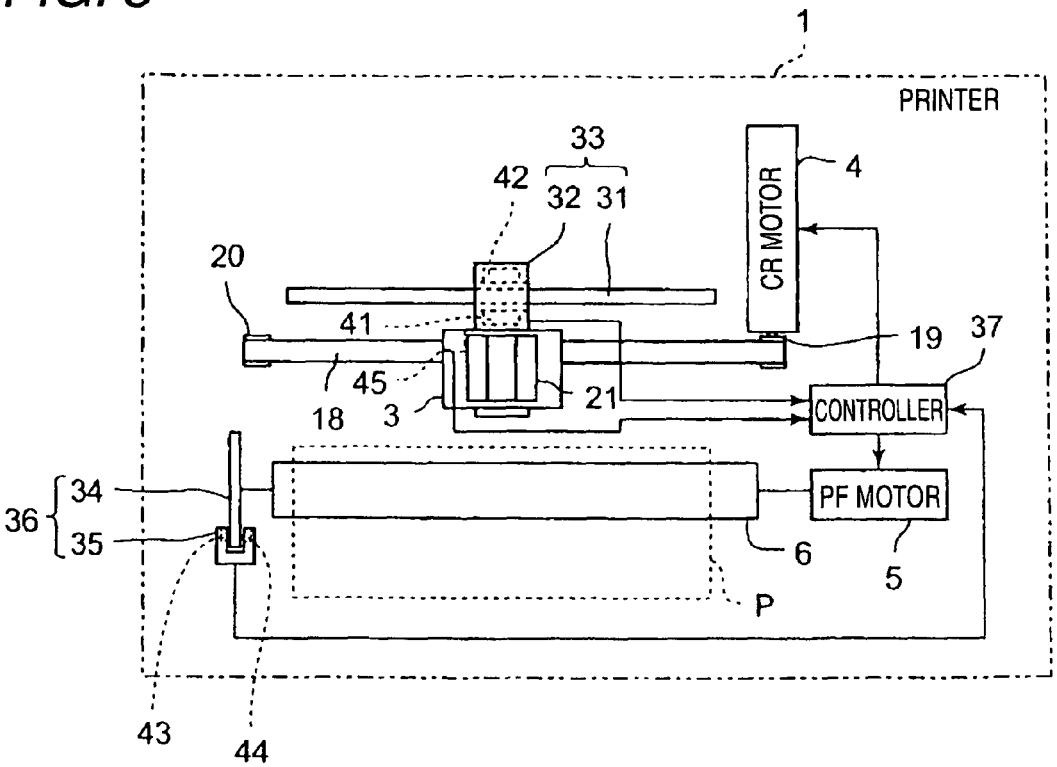
FIG. 3 is a diagram schematically illustrating configurations of a carriage shown in FIG. 1 and a detection mechanism of a PF driving roller shown in FIG. 2.
Figure 4:
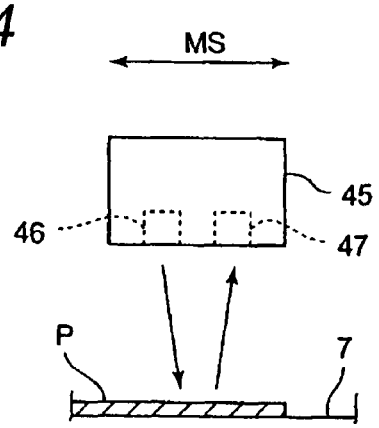
FIG. 4 is a front view schematically illustrating a configuration of an optical sensor shown in FIG. 2.

FIG. 1 is a perspective view schematically illustrating a configuration of a printer 1 according to an embodiment of the invention. FIG. 2 is a side view schematically illustrating a configuration of a part associated with a paper feeding operation of the printer 1 shown in FIG. 1. FIG. 3 is a diagram schematically illustrating configurations of a carriage 3 shown in FIG. 1 and a detection mechanism of a PF driving roller 6 shown in FIG. 2. FIG. 4 is a front view schematically illustrating a configuration of an optical sensor 45 shown in FIG. 2.

The printer according to this embodiment is an ink jet printer that carries out a printing operation by ejecting a liquid-like ink to a printing sheet P as a kind of printing medium. As shown in FIGS. 1 to 3, the printer 1 includes a carriage 3 mounted with a print head 2 for ejecting an ink, a carriage motor (CR motor) 4 for driving the carriage 3 in a main scanning direction MS, a paper feed motor (PF motor) 5 for transporting a printing sheet P in a sub scanning direction SS, a PF driving roller 6 connected to the PF motor 5, a platen 7 disposed to face an ink ejection surface (the lower surface in FIG. 2) of the print head 2, and a body chassis 8 housing the above-mentioned elements. Examples of the printing sheet P of this embodiment include a transparent film such as a seal or an OHP film, in addition to a sheet of regular paper used for a regular document print, a sheet of photo paper used for a photo print, and a paperboard thicker than the regular paper and the photo paper.

As shown in FIG. 2, the printer 1 includes a hopper 11 on which a before-print printing sheet P is placed, a feed roller 12 and a separation pad 13 which serve to feed the printing sheet P placed on the hopper 11 into the printer 1, a sheet detector 14 for detecting the passage of the printing sheet P fed into the printer 1 from the hopper 11, and a discharge driving roller 15 for discharging the printing sheet P from the printer 1.

The carriage 3 can be transported in the main scanning direction MS by a guide shaft 17 supported on a support frame 16 fixed to the body chassis 8 and a timing belt 18. That is, the timing belt 18, a part of which is fixed to the carriage 3 (see FIG. 2), is disposed to have a constant tension in a state where it suspended across a pulley 19 attached to an output shaft of the CR motor 4 and a pulley 20 rotatably attached to the support frame 16. The guide shaft 17 keeps the carriage 3 slidably movable so as to guide the carriage 3 in the main scanning direction MS. The carriage 3 is mounted with the print head 2 and an ink cartridge 21 storing a variety of inks supplied to the print head 2.

Plural nozzles not shown are disposed in the print head 2. Piezoelectric elements (not shown), which are one kind of electrostriction elements and have an excellent response property, are disposed in the print head 2 so as to correspond to the nozzles. Specifically, the piezoelectric elements are disposed at positions in contact with walls of ink passages (not shown). By allowing the walls to be pushed with the actions of the piezoelectric elements, the print head 2 ejects ink from the nozzles disposed at the ends of the passages. Specifically, the print head 2 ejects the ink from an ink ejection surface 2*a*.

The feed roller 12 is connected to the PF motor 5 through a gear not shown and is driven by the PF motor 5. As shown in FIG. 2, the hopper 11 is a plate-like member on which the printing sheet P can be placed and is pivotable about a rotation axis 22, which is disposed in the upper portion, by a cam mechanism not shown. The lower end of the hopper 11 is elastically pressed on the feed roller 12 and is separated from the feed roller 12 by means of the pivoting motion of the cam mechanism. The separation pad 13 is formed of a member having a high frictional coefficient and is disposed at a position opposed to the feed roller 12. The feed roller 12 need not be connected to the PF motor 12 and a driving motor for driving the feed roller 12 may be provided particularly.

When the feed roller 12 rotates, the surface of the feed roller 12 comes in contact with the separation pad 13. Accordingly, when the feed roller 12 rotates, the uppermost printing sheet P of the printing sheets P placed on the hopper 11 is fed to the discharge side through the contact portion between the surface of the feed roller 12 and the separation pad 13, but the second and subsequent printing sheets P are prevented from a feed to the discharge side by the separation pad 13.

The PF driving roller 6 is connected to the PF motor 5 directly or through a gear not shown. As shown in FIG. 2, the printer 1 is provided with a PF follower roller 23 for transporting the printing sheet P along with the PF driving roller 6. The PF follower roller 23 is rotatably held on the discharge side of a follower roller holder 24 which is pivotable about a rotation axis 25. The follower roller holder 24 is urged in the counterclockwise direction by a spring not shown so that an urging force directed to the PF driving roller 6 acts on the PF follower roller 23. When the PF driving roller 6 is driven, the PF follower roller 23 rotates with the rotation of the PF driving roller 6.

The sheet detector 14 includes a detection lever 26 and a photo sensor 27 as shown in FIG. 2 and is disposed in the vicinity of the follower roller holder 24. The detection lever 26 is rotatable about a rotation axis 28. When the printing sheet P completely passes below the detection lever 26 from the passing state of the printing sheet P shown in FIG. 2, the detection lever 26 rotates in the counterclockwise direction. When the detection lever 26 rotates, it blocks light traveling from a light-emitting element (not shown) of the photo sensor 27 to a light-receiving element (not shown), thereby detecting the passing end of the printing sheet P.

A discharge driving roller 15 is disposed on the discharge side of the printer 1 and is connected to the PF motor 5 through a gear not shown. As shown in FIG. 2, the printer 1 is provided with a discharge follower roller 29 for discharging the printing sheet P along with the discharge driving roller 15. The discharge follower roller 29 is urged toward the discharge driving roller 15 by a spring not shown, similarly to the PF follower roller 23. When the discharge driving roller 15 is driven, the discharge follower roller 29 also rotates with the rotation of the discharge driving roller 15.

As shown in FIGS. 2 and 3, the printer 1 includes a linear encoder 33 having a linear scale 31 and a photo sensor 32 as a position detector for detecting a position of the carriage 3 and a speed of the carriage 3 in the main scanning direction MS. As shown in FIG. 3, the printer 1 includes a rotary encoder having a rotary scale 34 and a photo sensor 35 as a position detector for detecting a position of the printing sheet P and detecting a transport speed of the printing speed P in the sub scanning direction SS (specifically, detecting the rotational position and the rotational speed of the PF driving roller 6). The position detection signals output from the linear encoder 33 and the rotary encoder 36 are input to the controller 37 for performing various control operations on the printer 1 as shown in FIG. 3, thereby performing the various control operations on the printer 1. For the purpose of convenience, the linear scale 31 and the like is not shown in FIG. 1.

The photo sensor 32 of the linear encoder 33 has a light-emitting element 41 and a light-receiving element 42 as shown in FIGS. 2 and 3. The photo sensor 32 is fixed to the bottom of the carriage 3 (a deep side in the paper surface of FIG. 1). The linear scale 31 is formed in a longitudinal rectangular shape (long and thin straight line shape) out of a thin plate of a transparent resin or the like. The linear scale 31 is attached to the support frame 16 to be parallel to the main scanning direction MS. Alight-transmitting portion (not shown) for transmitting light from the light-emitting element 41 of the photo sensor 32 and a light-blocking portion (not shown) for blocking the light from the light-emitting element 41 are alternately formed in the longitudinal direction in the linear scale 31. When the carriage 3 moves, the linear scale 31 relatively moves between the light-emitting element 41 and the light-receiving element 42 of the photo sensor 32. With the relative movement of the linear scale 31, the photo sensor 32 outputs a position detection signal with a period corresponding to the moving speed of the carriage 3.

The photo sensor 35 of the rotary encoder 36 includes a light-emitting element 43 and a light-receiving element 44 as shown in FIG. 3 and is fixed to the body chassis 8 with a bracket (not shown) interposed therebetween. The rotary scale 34 is formed in a disc shape out of a thin plate of a transparent resin or the like. The rotary scale 34 of this embodiment is attached to the PF driving roller 6 so as to rotate integrally with the PF driving roller 6. That is, when the PF driving roller 6 rotate by one turn, the rotary scale 34 also rotates by one turn. A light-transmitting portion (not shown) for transmitting light from the light-emitting element 43 of the photo sensor 35 and a light-blocking portion (not shown) for blocking the light from the light-emitting element 43 are alternately formed in the circumferential direction of the rotary scale 34. When the PF driving roller 6 rotates, the rotary scale 34 relatively rotates between the light-emitting element 43 and the light-receiving element 4 of the photo sensor 35. With the relative rotation of the rotary scale 34, the photo sensor 35 outputs a position detection signal with a period corresponding to the rotational speed of the PF driving roller 6.

As shown in FIGS. 2 to 4, the printer 1 includes an optical sensor 45 for detecting an end of a printing sheet P in the main scanning direction (moving direction of the carriage 3) and detecting an end of the printing sheet P in the sub scanning direction SS (that is, the leading end and the trailing end of the printing sheet P). The optical sensor 45 is fixed to the carriage 3 as shown in FIG. 2. Specifically, the optical sensor 45 is fixed to the bottom surface of the carriage and an upstream side (the right side in FIG. 2) of the print head 2 in the sub scanning direction SS. As shown in FIG. 3, the optical sensor 45 is fixed to the leftmost end of the carriage 3 in the main scanning direction MS.

As shown in FIG. 4, the optical sensor 45 is a reflective optical sensor having a light-emitting element 46 for emitting light toward the platen 7 or the printing sheet P and a light-receiving element 47 for receiving the light emitted from the light-emitting element 46 and reflected by the platen 7 or the printing sheet P so as to detect an end of the printing sheet P. In the optical sensor 45, light is emitted from the light-emitting element 46 to the platen 7 or the printing sheet P and the light reflected by the platen 7 or the printing sheet P is incident on the light-receiving element 47, with the movement of the carriage 3 in the main scanning direction or with the transporting of the printing sheet P in the sub scanning direction SS in the state where the carriage 3 is stopped. The optical sensor 45 is electrically connected to the controller 37 as shown in FIG. 3.

(2) Schematic Configuration of Optical Sensor and Controller

Figure 5:
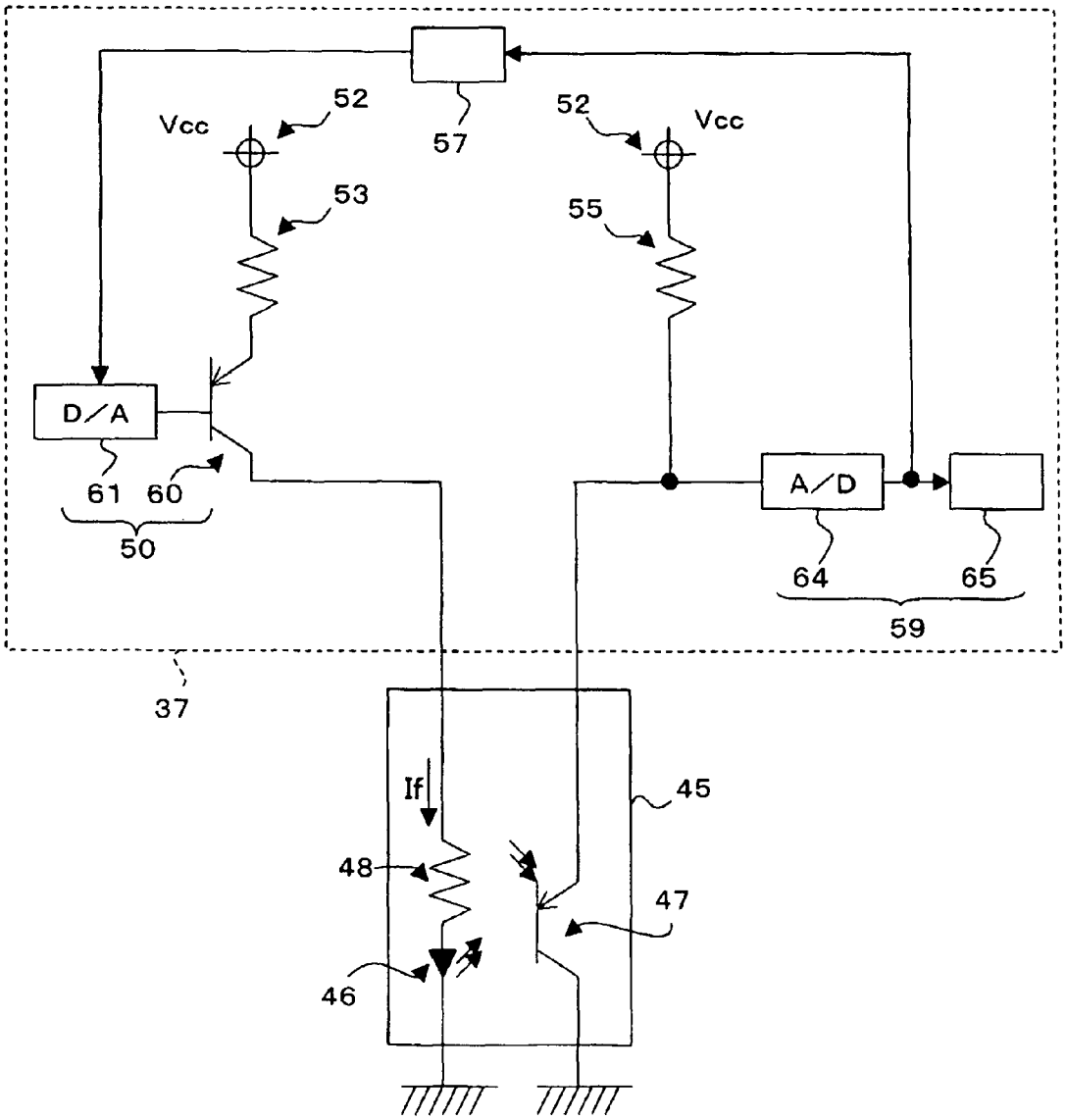
FIG. 5 is a diagram schematically illustrating a configuration of the optical sensor and a controller shown in FIG. 3.

FIG. 5 is a diagram schematically illustrating a configuration of the optical sensor 45 and the controller 37 shown in FIG. 3. In FIG. 5, only the inner configuration of the controller 37 associated with the optical sensor 45 is shown.

As described above, in this embodiment, the optical sensor 45 is a reflective photo interrupter having the light-emitting element 46 and the light-receiving element 47. The optical sensor 45 has a light emitting diode as the light-emitting element 46 as shown in FIG. 5 and has a photo transistor as the light-receiving element 47. In the optical sensor 45, a resistor 48 is disposed on the current input side of the light-emitting element 46.

The optical sensor 45 outputs an output signal corresponding to an amount of light received by the light-receiving element 47. That is, the optical sensor 45 outputs an output signal which is at a low level at the time of detecting the printing sheet P and which is at a high level at the time of not detecting the printing sheet P. The output signal is at the low level when the light-receiving element 47 receives the light emitted from the light-emitting element 46 and reflected by the printing sheet P, and is at the high level when the light-receiving element 47 receives the light emitted from the light-emitting element 46 and reflected by the platen 7. In this embodiment, the platen 7 is formed of a black member having low light reflectance. The printing sheet P having light reflectance higher than that of the platen 7 reflects a larger amount of light than the platen 7 does. Accordingly, when the amount of light received by the light-receiving element 47 is great, the output signal is at the low level. On the other hand, when the amount of light received by the light-receiving element 47 is small, the output signal is at the high level. When the amount of light received by the light-receiving element 47 increases (that is, when the value of current flowing in the light-receiving element 47 increases), the level of the output signal decreases. When the amount of light received by the light-receiving element 47 decreases (that is, when the value of current flowing in the light-receiving element 47 decreases), the level of the output signal increases.

As shown in FIG. 5, the controller 37 includes an emission intensity adjusting section 50 for adjusting emission intensity of the light-emitting element 46, an inner power supply 52 as a power source for supplying current to the light-emitting element 46 and the light-receiving element 47, a resistor 53 connected between the inner power supply 52 as the power source for supplying current to the light-emitting element 46 and the emission intensity adjusting section 50, a resistor 55 connected between the inner power supply 52 for supplying current to the light-receiving element 47 and the light-receiving element 47, and an end detector 59 for detecting an end of a printing sheet P.

The end detector 59 has an A/D converter 64 and an end determining section 65. The output signal of the optical sensor 45 is input to the A/D converter 64. The A/D converter 64 has a function of converting an output voltage of the optical sensor 45 into a digital value. For example, in case of a 8-bit A/D converter, 3.3 V is converted into a digital value 255 and 0.0 V is converted into a digital value 0. The end determining section 65 determines the end of the printing sheet P on the basis of the digital value output from the A/D converter 64.

The emission intensity adjusting section 50 includes a transistor 60 disposed between the resistor 53 and the light-emitting element 46 and a D/A converter 61 connected to a base terminal of the transistor 60. The transistor 60 is a PNP type transistor, a collector terminal of which is connected to the light-emitting element 46 and a emitter terminal of which is connected to the inner power supply 52 through the resistor 53.

A path returning from a node between the A/D converter 64 and the end determining section 65 to the D/A converter 61 is provided with an output monitoring section 57 for monitoring the output voltage of the optical sensor 45 to control the adjustment of the emission intensity of the emission intensity adjusting section 50. The D/A converter 61 changes the current from the emitter terminal of the transistor 60 to the collector terminal thereof, that is, the current supplied from the inner power supply 52 to the light-emitting element 46, with a predetermined resolution under the control of the output monitoring section 57, thereby adjusting the emission intensity of the light-emitting element 46. The D/A converter 61 stops the supply of current to the light-emitting element 46 on the basis of a control instruction of the output monitoring section 57. The end determining section 65 and the output monitoring section 57 of the end detector 59 are embodied by calculation means such as a CPU of the controller 37, storage means such as an ROM, an RAM, and a non-volatile memory, and input and output means such as an IO port.

The digital value of the A/D converter 64 is input to the output monitoring section 57. The output monitoring section 57 controls the D/A converter 61 while monitoring the level (output voltage) of the output signal at the time of detecting the printing sheet P and selects the digital value of the D/A converter 61 to acquire the level of the output signal for detecting an end of the printing sheet P. Specifically, the output monitoring section 57 monitors the output voltage of the optical sensor 45 at the time of setting the digital value while raising the digital value of the D/A converter 61 and selects the digital value of the D/A converter 61 when the output voltage is in minimum. The output monitoring section 57 selects the digital value of the D/A converter 61 at the time of outputting the output voltage, when it is determined that the output voltage is lower than a target output voltage while monitoring the output voltage of the optical sensor 45 by the use of the digital values input from the A/D converter 64.

(3) Method of Selecting Digital Value of D/A converter

Figure 6:
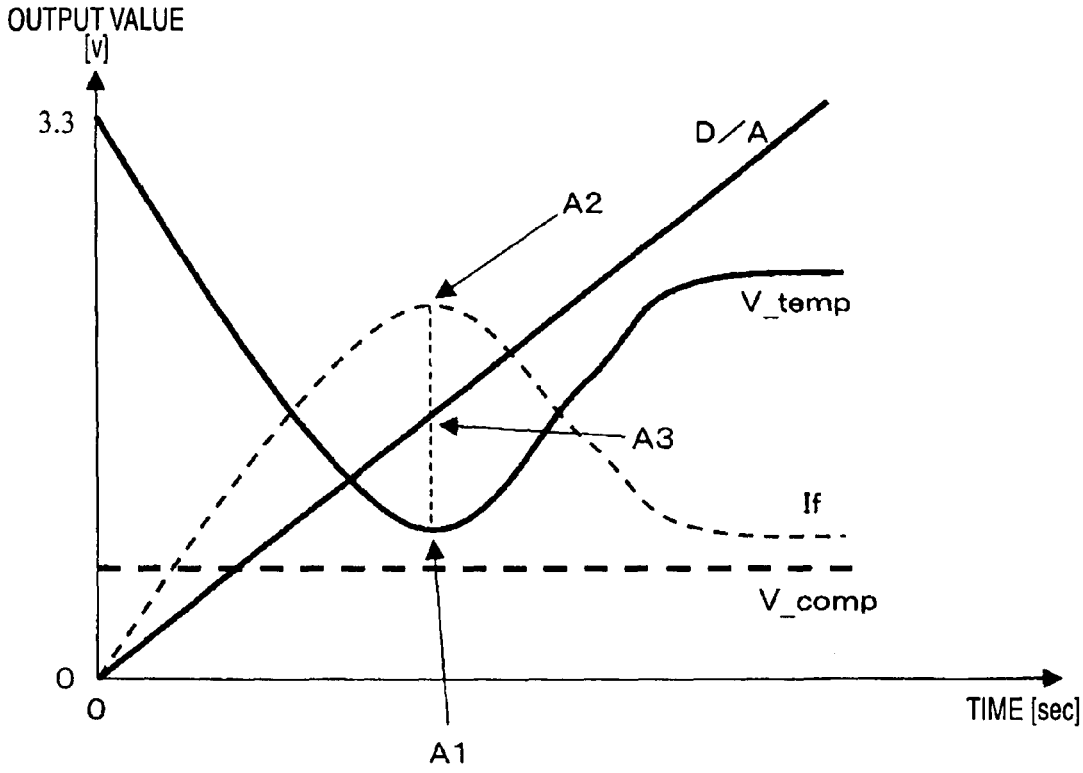
FIG. 6 is a diagram illustrating a relationship between a digital value of a D/A converter and an output voltage of the optical sensor in FIG. 5.

FIG. 6 is a graph schematically illustrating a relationship between the digital value of the D/A converter 61 and the output voltage of the optical sensor 45. In FIG. 6, the value of current flowing in the light-emitting element 46 of the optical sensor 45 is indicated by a thin dot line and the target value of the output voltage (the value of the target output voltage) of the optical sensor 45 is indicated by a thick dot line.

When the digital value of D/A converter 61 is raised as indicated by a straight line "D/A" in FIG. 6, the output voltage of the optical sensor 45 is not lowered unilaterally from the initial value 3.3 V but may be raised from a certain point ("A1" in FIG. 6) as the minimum value, as indicated by a curved line "V_temp" in FIG. 6. In this case, when the digital value of the D/A converter 61 is raised, the current flowing in the light-emitting element 46 of the optical sensor 45 is not raised unilaterally but is lowered from a certain point ("A2" in FIG. 6) as the maximum value, as indicated by a curved line "If" in FIG. 6. Accordingly, even when the digital value of the D/A converter 61 is set to the maximum, the current flowing in the light-emitting element 46 is not set to the maximum.

In this embodiment, the output monitoring section 57 monitors the output voltage of the optical sensor 45 while raising the digital value of the D/A converter and specifies the digital value of the D/A converter 61 (the value of the point indicated by "A3" in FIG. 6) when the output voltage is in minimum. As a result, the current flowing in the light-emitting element 46 can be set to the maximum. Even when the relationship between the digital value of the D/A converter 61 and the output voltage of the optical sensor 45 varies due to a deterioration of the optical sensor 45 with the lapse of time resulting from attachment of ink mist, uneven performance of the optical sensor 45, the type of the printing sheet, and characteristics of the transistor 60 in the circuit on which the optical sensor 45 is mounted, a sufficient amount of current to accurately detect an end of a printing sheet P can be made to flow in the light-emitting element 46.

Figure 7:
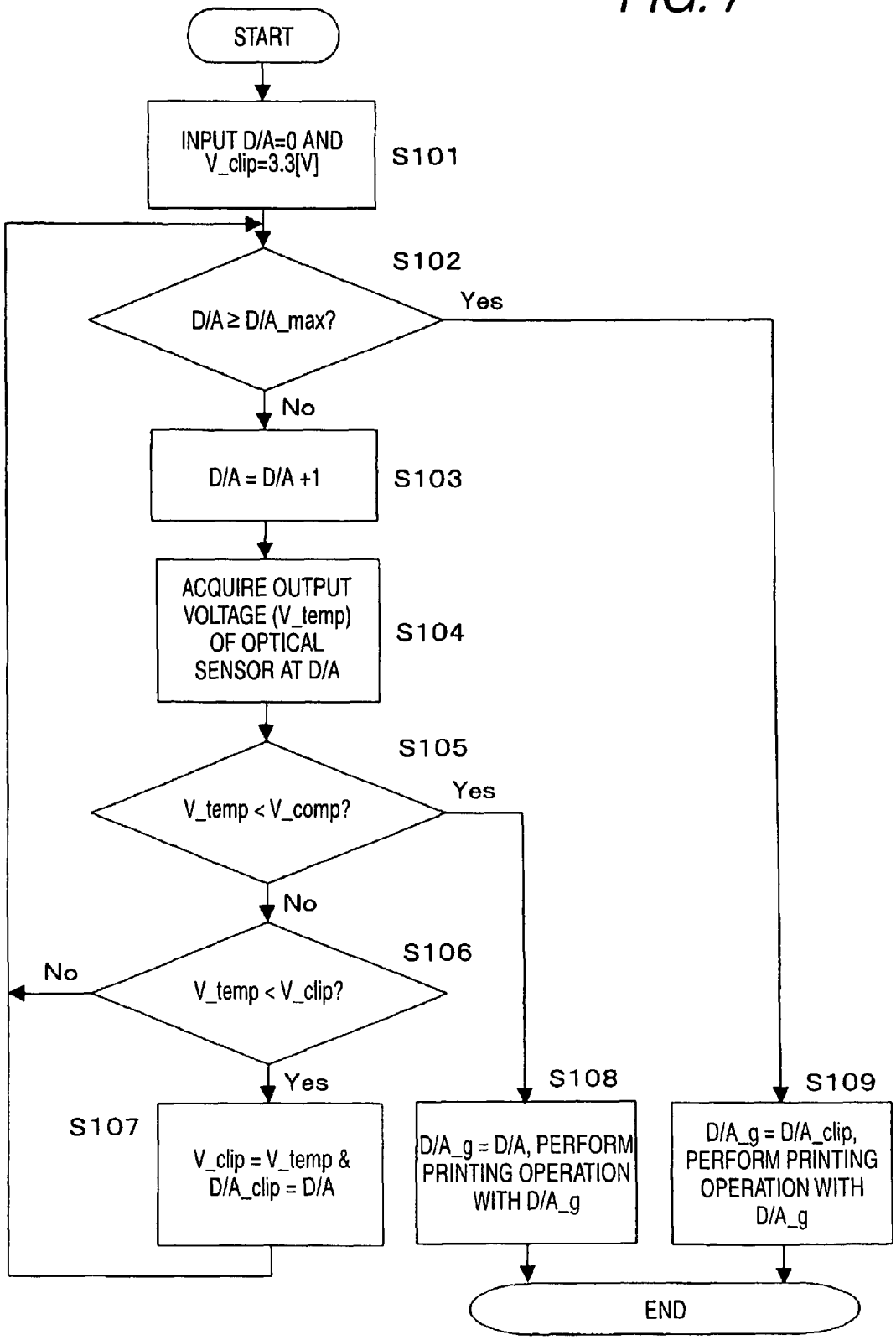
FIG. 7 is a flowchart illustrating an emission intensity adjusting method of a light emitting element shown in FIG. 3.

FIG. 7 is a flowchart illustrating an example of a flow of processes for adjusting the emission intensity of the light-emitting element 46 by selecting the digital value of the D/A converter 61 by the use of the controller 37. Hereinafter, the emission intensity adjusting method according to this embodiment will be described with reference to FIG. 7.

In FIG. 7, "D/A" denotes the digital value of the D/A converter 61, "D/A_max" denotes the maximum value of the digital value of the D/A converter 61, "V_temp" denotes the output voltage of the optical sensor 45 when a certain D/A value is used, "V_comp" denotes the output voltage (=target output voltage" of the optical sensor 45 which serves as a target, "V_clip" denotes the optimal output voltage (usually, the minimum output voltage) of the optical sensor 45, "D/A_clip" denotes the digital value of the D/A converter 61 which is used to obtain the optimal output voltage of the optical sensor 45, and "D/A_g" denotes the digital value of the D/A converter 61 set in print. In this embodiment, the maximum value of the digital value of the D/A converter 61 is 255.

First, the output monitoring section 57 receives D/A=0 and V_clip=3.3 V as an initial value (step S101). Next, the output monitoring section 57 determines whether D/A is equal to or greater than D/A_max (step S102). When it is determined in step S102 that D/A is equal to or greater than D/A_max, the process of step S109 is performed. On the other hand, when it is determined in step S102 that D/A is smaller than D/A_max, the process of step S103 is performed. At the initial time of processes, since D/A is smaller than D/A_max, the process of step S103 is performed. Next, the output monitoring section 57 raises the digital value of the D/A converter 61 by 1 (step S103). Then, the output monitoring section 57 acquires the output voltage (V_temp) of the optical sensor which is obtained by the use of D/A set in step S103 (step S104).

Next, the output monitoring section 57 determines whether V_temp acquired in step S104 is lower than the target output voltage (V_comp) (step S105). When it is determined in step S105 that V_temp is lower than V_comp, the process of step S108 is performed. On the other hand, when it is determined in step S105 that V_temp is equal to or greater than V_comp, the output monitoring section 57 determines whether V_temp is lower than V_clip (3.3 V at the initial time) (step S106).

When it is determined in step S106 that V_temp is lower than V_clip (3.3 V at the initial time), the output monitoring section 57 sets V_clip to V_temp acquired in step S104 and sets D/A_clip, which is a candidate for selection, to D/A set in step S103 (step S107). Next, the output monitoring section 57 returns the process of step S102. On the other hand, when it is determined in step S106 that V_temp is equal to or greater than V_clip (3.3 V at the initial time), the output monitoring section 57 returns to the process of step S102 without performing the process of step S107.

So long as V_temp is unilaterally lowered with an increase in D/A, the output monitoring section 57 performs the process of S107 and compares the present output voltage with the output voltage acquired in the previous routine, in step S106 of the subsequent routine. On the other hand, when V_temp is raised with an increase in D/A, the output monitoring section 57 performs the process of step S102 without performing the process of step S107. Accordingly, the output monitoring section 57 compares the present output voltage with the lower output voltage in the previous routine, in step S106 of the subsequent routine.

In this way, the output monitoring section 57 repeats the processes of steps S102 to S107 to grasp the minimum V_temp. In the course of performing the processes of steps S102 to S107, when it is determined in step S105 that V_temp is lower than V_comp, the output monitoring section 57 sets D/A_g to D/A at that time and allows the printing operation to be carried out by the use of D/A_g (step S108). When the processes of steps S102 to S107 are repeated without performing the process of step S108 and it is determined in step S102 that D/A is equal to or greater than D/A_max, the output monitoring section 57 sets D/A_g to D/A_clip which is a candidate for selection by that time and allows the printing operation to be carried out by the use of the relevant D/A_g (step S109). When the process of step S108 or S109 is ended, the processes of the emission intensity adjusting method are finished.

In the printer 1 having the above-mentioned configuration, the carriage 3 driven by the CR motor 4 reciprocates in the main scanning direction MS while a printing sheet P fed into the printer 1 from the hopper 11 by the feed roller 12 and the separation pad 13 is transported in the sub scanning direction SS by the use of the PF driving roller 6 driven to rotate by the PF motor 5. When the carriage 3 reciprocates, an ink is ejected from the print head 2 to perform a printing operation on the printing sheet P. When the printing operation on the printing sheet P is finished, the printing sheet P is discharged to the outside from the printer by the use of the discharge driving roller 15 and the like.

Before performing the printing operation, the printing sheet P is transported to a position where the printing sheet can be detected by the optical sensor 45. The output monitoring section 57 monitors the output voltage of the optical sensor 45 using the digital value while raising the digital value of the D/A converter 61 in accordance with the processes of the above-mentioned flowchart. As a result, the digital value of the D/A converter 61 is selected when the output voltage of the optical sensor 45 is in minimum or less than the target output voltage. When the digital value of the D/A converter 61 suitable for detecting an end of a printing sheet is selected, the controller 37 allows current to flow in the light-emitting element 46 on the basis of the digital value. As a result, an output signal is output from the optical sensor 45 and the output signal is input to the end detector 59. The end detector 59 detects an end of a printing sheet P. Then, a variety of control operations are performed on the printer 1 on the basis of the end detection result of the printing sheet P.

In this embodiment, the printing sheet P is transported in the sub scanning direction SS by the use of the PF driving roller 6 and the like in the state where the carriage 3 is stopped at the position where the printing sheet P can be detected by the optical sensor 45 and the end detector 59 detects the leading end of the printing sheet Pin the sub scanning direction. However, the end detector 59 may detects the trailing end of the printing sheet P in the sub scanning direction SS. The end detector 59 may detect an end of the printing sheet P in the main scanning direction MS (an end in the width direction).

Figure 8:
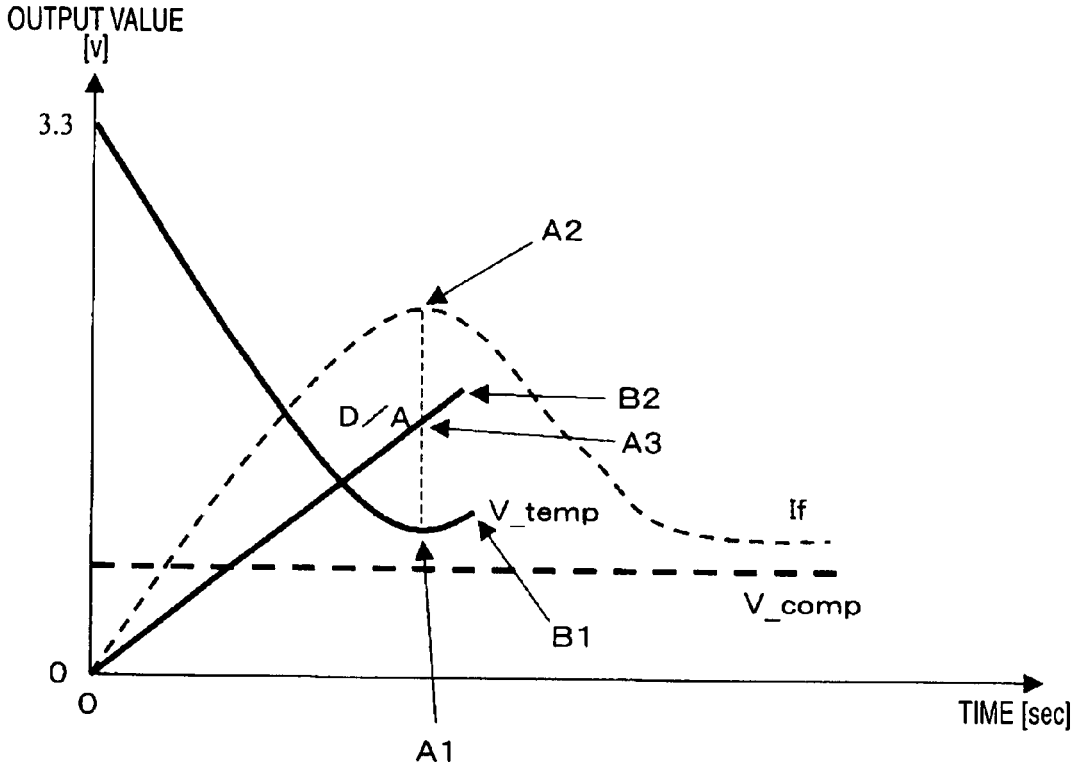
FIG. 8 is a diagram illustrating a relationship between the digital value and the output voltage, which is different from FIG. 6.

FIG. 8 is a graph schematically illustrating the relationship between the digital value of the D/A converter 61 and the output voltage of the optical sensor 45 when the minimal value is obtained before raising the digital value of the D/A converter 61 to the maximum value, unlike FIG. 6. The straight line and the curved line shown in the graph of FIG. 8 are of the same kinds as the straight line and the curved line shown in FIG. 6.

FIG. 6 which has been described above is a graph illustrating the variation in output voltage of the optical sensor 45 when the digital value of the D/A converter 61 is raised to the maximum value. On the contrary, FIG. 8 is a graph illustrating a state where the raising of the digital value of the D/A converter 61 is stopped at the step where it is obtained that the output voltage of the optical sensor 45 has the minimal value while raising the digital value of the D/A converter 61. When it is apparent that two or more minimal values do not exist in the output voltage of the optical sensor 45 even without raising the digital value of the D/A converter 61 to the maximum value thereof, the process of selecting the digital value may be ended in the way.

As shown in FIG. 8, it is assumed that when the digital value of the D/A converter 61 is raised to the value of point B, the output monitoring section 57 acquires the output voltage of the optical sensor 45 at point B1. The value of point B1 is larger than the output voltage (the value of point A1) of the optical sensor 45 when the previous digital value is used. In this case, the digital value (the value of point A3) for outputting the value of point A1 as the minimal value is set as the digital value of the D/A converter 61 to be selected. Accordingly, it is possible to allow current with the value of point A2 to flow in the light-emitting element 46.

Figure 9:
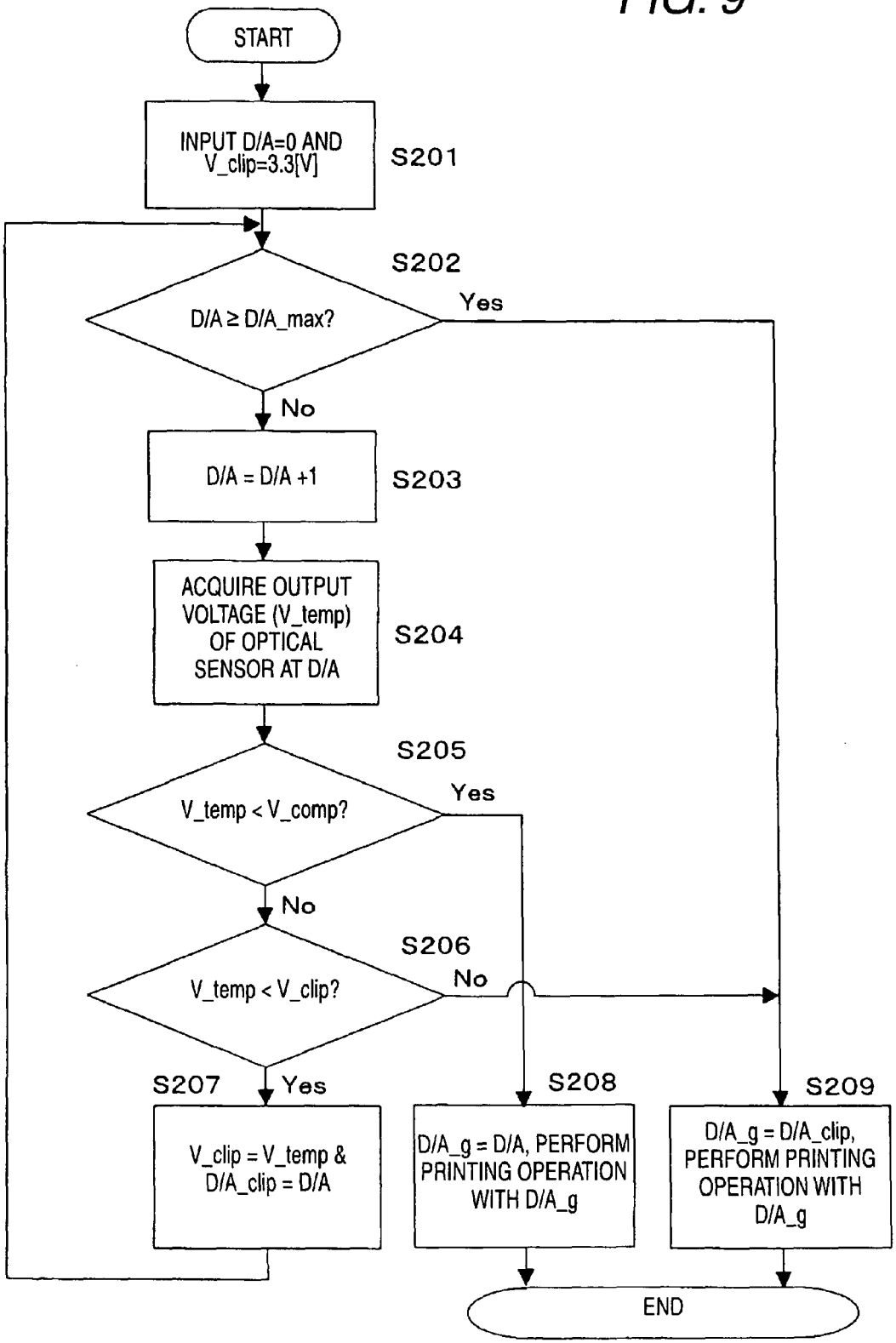
FIG. 9 is a flowchart illustrating an emission intensity adjusting method, which is different from FIG. 7.

FIG. 9 is a flowchart used for embodying the processes described with reference to FIG. 8. Hereinafter, a modified example of the emission intensity adjusting method according to this embodiment will be described with reference to FIG. 9.

Step S201, step S202, step S203, step S204, step S205, step S207, step S208, and step S209 in the flowchart of FIG. 9 are equal to step S101, step S102, step S103, step S104, step S105, step S107, step S108, and step S109 in the flowchart of FIG. 7, respectively. The flowchart of FIG. 9 is different from the flowchart of FIG. 7, in that processes to be performed after the determination of step S206 of FIG. 9 and step S106 of FIG. 7 are different from each other.

Specifically, in step S206 of FIG. 9, the output monitoring section 57 determines whether V_temp is lower than V_clip. When it is determined in step S206 that V_temp is lower than V_clip, the process of step S207 is performed. However, when V_temp is equal to or greater than V_clip, the output monitoring section 57 performs the process of step S209 without returning to the process of step S202. That is, when V_temp is equal to or greater than V_clip, the output monitoring section 57 selects the digital value of the D/A converter 61 used to obtain the previous output voltage (V_clip). In this way, when it is determined that the output voltage of the optical sensor 45 has the minimal value, the raising of the digital value of the D/A converter 61 may be stopped and the processes may be ended.

An emission intensity adjusting method may be employed in which the processes of step S105 and step S108 in the flowchart of FIG. 7 or the processes of step S205 and step S208 in the flowchart of FIG. 9 are not performed. When the target output voltage is not set, the processes of step S105 and step S108 or the processes of step S205 and step S208 are not necessary. Even when the target output voltage is set, the digital value which is the smallest output voltage may be employed, regardless of the relative greatness to the target output voltage, without performing the processes of step S105 and step S108 or the processes of step S205 and step S208. When such a flowchart is employed, the output monitoring section 57 raises the digital value of the D/A converter 61 to the maximum value and selects the digital value corresponding to the smallest output voltage, or selects the digital value corresponding to the minimal value when the minimal value of the output voltage of the optical sensor 45 appears while raising the digital value of the D/A converter 61.

(4) Advantages of This Embodiment

The printer 1 according to this embodiment includes the optical sensor 45 that detects the printing medium, the emission intensity adjusting section 50 that adjusts emission intensity of a light-emitting element 46 constituting the optical sensor 45, and the output monitoring section 57 that monitors an output voltage of the optical sensor 45 so as to control the emission intensity adjusting section 50 to adjust the emission intensity. Accordingly, in the course of monitoring the output voltage of the optical sensor 45, it is possible to specify the condition of the emission intensity adjusting section 50 when the output voltage thereof is lowered. Therefore, even when the relationship between the adjustment condition of the emission intensity adjusting section 50 and the output voltage of the optical sensor 45 varies due to a deterioration of the optical sensor 45 with the lapse of time resulting from attachment of ink mist, uneven performance of the optical sensor 45, the type of the printing sheet P, and characteristics of the transistor 60 in the circuit on which the optical sensor 45 is mounted, a sufficient amount of current to accurately detect an end of a printing sheet P can be made to flow in the light-emitting element 46.

The printer 1 according to this embodiment includes as the emission intensity adjusting section 50 the transistor 60 disposed between the inner power supply 52 for supplying current to the light-emitting element 46 and the light-emitting element 46 and the D/A converter 61 connected to the base terminal of the transistor 60. The output monitoring section 57 acquires an output voltage of the optical sensor 45 while varying the digital value of the D/A converter 61. Accordingly, it is possible to select the digital value of the D/A converter 61 to optimize the value of current flowing in the light-emitting element 46 while monitoring the variation of the output voltage of the optical sensor 45.

The output monitoring section 57 of the printer 1 selects the digital value of the D/A converter 61 when acquiring the minimum or minimal value of the output voltage of the optical sensor 45. The minimum value of the output voltage of the optical sensor 45 can be obtained by checking the output voltage of the optical sensor 45 at the time of varying the digital value within the range of the digital value having been varied. The minimal value of the output voltage of the optical sensor 45 may be obtained while varying the digital value, in addition to the method of acquiring the minimum value. When the minimal value of the output voltage is obtained in the way of varying the digital value, the digital value need not be varied to the maximum value. Accordingly, it is possible to select the digital value of the D/A converter 61 to optimize the emission intensity with a rapid process.

The output monitoring section 57 of the printer 1 selects the digital value of the D/A converter 61 to specify the output voltage when the output voltage of the optical sensor 45 is equal to or less than the target output voltage. Accordingly, since the digital value of the D/A converter 61 need not be varied to the maximum value, it is possible to select the digital value of the D/A converter 61 to optimize the emission intensity with a further rapid process. Even when the output voltage of the optical sensor 45 is not the minimum or minimal value, it is possible to find out the digital value to acquire the output voltage equal to or less than the target output voltage.

The printer 1 according to this embodiment includes the print head 2 that ejects an ink to the printing sheet P and the carriage 3 that is mounted with the print head 2, and the optical sensor 45 is attached to the carriage 3 so as to detect an end of the printing sheet P. When it is necessary to allow current having a value as large as possible to flow in the light-emitting element 46 in order to increase the difference in output voltage as greatly as possible depending on the existence of the printing sheet P, it is possible to optimize the adjustment condition of the emission intensity adjusting section 50. Specifically, when the output value of the optical sensor 45 is small, the value of current flowing in the light-emitting element 46 may not be increased only by simply raising the digital value of the D/A converter 61. Accordingly, by monitoring the output voltage of the optical sensor 45, it is necessary to acquire the adjustment condition of the emission intensity adjusting section 50 that the output voltage is small and the value of current flowing in the light-emitting element 46 is great.

In this embodiment, the emission intensity of the light-emitting element 46 is adjusted by the use of the emission intensity adjusting section 50. Accordingly, it is possible to maintain the precision for detecting an end of a printing sheet P and thus to stably detect the end of the printing sheet P. Accordingly, even when a so-called no-edge printing operation is performed on the printing sheet P, it is possible to reduce an amount of wasted ink ejected to areas other than the printing sheet P. That is, when an error temporally occurring at the position for detecting the end of the printing sheet P is great and thus the end of the printing sheet P cannot be stably detected, the print head 2 necessarily ejects an ink to an extra wide area so as to properly maintain a printing state of the no-edge printing operation.

On the contrary, when an error temporally occurring at the position for detecting the end of the printing sheet P is not great and thus the end of the printing sheet P can be stably detected, the print head 2 need not eject an ink to then extra wide area, thereby properly maintaining a printing state of the no-edge printing operation. In this embodiment, even when the no-edge printing operation is performed on the printing sheet P, it is possible to reduce the amount of wasted ink. As a result, it is possible to suppress the occurrence of ink mist which causes the variation in output voltage of the optical sensor 45. In business printers using large printing sheets P such as A1 or A2 as printing mediums, since the amount of wasted ink can be greatly reduced, the advantage is more marked in the business printers than in the home printers using small printing sheets P such as A4 as printing mediums.

In this embodiment, the emission intensity adjusting section 50 includes the transistor 60 and the D/A converter 61. Accordingly, it is possible to supply stepwise current corresponding to the resolution of the D/A converter 61 to the light-emitting element 46. As a result, it is possible to finely adjust the brightness of the light-emitting element 46.

Although the printer and the emission intensity adjusting method according to the exemplary embodiments of the invention have been described above, the invention is not limited to the embodiments but may be modified in various forms without departing from the gist of the invention.

In addition to the detection of an end of a sheet, the printer and the emission intensity adjusting method according to the invention can be used for detection of a portion of a sheet other than an end of the sheet and different optical detectors such as the linear encoder 33 and the rotary encoder 36. When the invention is applied to the sheet detector 14, the printing sheet P is an object to be detected by the sheet detector 14. When the invention is applied to the linear encoder 33, the carriage 3 is an object to be detected by the linear encoder 33. When the invention is applied to the rotary encoder 36, the PF driving roller 6 is an object to be detected by the rotary encoder 36.

In the embodiments, the controller 37 physically separated from the optical sensor 45 includes the emission intensity adjusting section 50, the output monitoring section 57, and the resistors 53 and 55. However, the emission intensity adjusting section 50, the output monitoring section 57, and the resistors 53 and 55 may be disposed in the optical sensor 45.

In the embodiments, the optical sensor 45 is a reflective photo interrupter. Otherwise, the optical sensor 45 may be a light transmitting and receiving sensor in which a light-emitting surface of a light-emitting element and a light-receiving surface of a light-receiving element are disposed opposite to each other. In this case, it is preferable that the brightness of the light-emitting element is adjusted so that the level of an output signal at the time of not detecting an object is in a predetermined range. As described above, the output signal when the light from the light-emitting element is more received by the light-receiving element greatly varies in level due to the ink mist and the temporal deterioration in amount of light emitted from the light-emitting element. Accordingly, with the configuration of the reflective sensor type, it is possible to properly suppress the variation in level of the output signal and thus to more properly maintain the detection precision. When the optical sensor 45 is the light transmitting and receiving sensor, it is preferable that a level checking process of checking the level of the output signal at the time of not detecting an object is performed after adjusting the level of the output signal at the time of not detecting an object.

In the embodiments, the ink cartridge 21 is mounted on the carriage 3. Otherwise, the ink cartridge may be fixed to the body chassis 8. In this case, the ink cartridge fixed to the body chassis 8 and the print head 3 mounted on the carriage 3 may be connected to each other with a flexible ink supply tube.

In the embodiments, the light-receiving element 47 is a photo transistor. However, the light-receiving element 47 may be a photo diode. The configuration of the emission intensity adjusting section 50 is not limited to the above-mentioned configuration. For example, a variable resistor may be used instead of the D/A converter 61. The transistor 60 may be an NPN type transistor or a field effect transistor (FET).

In step S102 or step S202, it may be determined whether D/A is equal to D/A_max. In step S105 or step S205, it may be determined whether V_temp is equal to or less than V_comp. Instead of selecting the digital value of the D/A converter 61 at the time of acquiring the minimum or minimal value of the output voltage of the optical sensor 45, the output voltage may be acquired continuously and the digital value of the D/A converter 61 under the printing condition may be selected. For example, when plural digital values exist for acquiring the output voltage equal to or less than the target output voltage, a specific digital value may be randomly selected from the plural digital values and current may be made to flow in the light-emitting element 46 of the optical sensor 45 by the use of the selected digital value. In this case, since the selected digital value does not set the output voltage of the optical sensor 45 to the minimum but serves to acquire the output voltage equal to or less than the target output voltage, it is possible to obtain sufficient emission intensity.

What is claimed is:

1. A printer for performing a printing operation on a printing medium, the printer comprising:

a light emitter including a light-emitting element, emission intensity of the light emitter being varied in accordance with a value of current flowing in the light-emitting element;

a light receiver including a light-receiving element, and outputting a signal in accordance with amount of light received by the light-receiving element;

an output monitor monitoring the signal output by the light receiver, and varying an adjustment value;

an emission adjuster varying the value of current flowing in the light-emitting element in accordance with the adjustment value; and a transporter transporting the printing medium to a position at which the printing medium is detected by the light emitter and the light receiver, wherein the output monitor raises the adjustment value such that the value of current flowing in the light-emitting element is increased, and when the value of current flowing in the light-emitting element is a maximum value, the output monitor selects a selected adjustment value that corresponds to the maximum value as an adjustment value for printing in the printing operation.

* * * * *